US006220822B1

(12) United States Patent
Khudenko

(10) Patent No.: US 6,220,822 B1
(45) Date of Patent: Apr. 24, 2001

(54) AIRLIFT

(76) Inventor: Boris Mikhailovich Khudenko, 744 Moores Mill Rd., Atlanta, GA (US) 30327

( * ) Notice: Subject to any disclaimer, the term of this patent is extended or adjusted under 35 U.S.C. 154(b) by 0 days.

(21) Appl. No.: 09/348,196

(22) Filed: Jul. 6, 1999

(51) Int. Cl.[7] ..... F04F 19/24
(52) U.S. Cl. ..... 417/54
(58) Field of Search ..... 417/54, 108, 109

(56) References Cited

U.S. PATENT DOCUMENTS 3,028,816 * 4/1962 Walker et al. ..... 417/108
3,694,106 * 9/1972 Walker ..... 417/109
5,382,137 * 1/1995 Lane ..... 417/108

* cited by examiner

*Primary Examiner*—Timothy S. Thorpe
*Assistant Examiner*—William H Rodriguez

(57) ABSTRACT

A method for lifting liquids with airlift consisting of a lift pipe having a suction port, a discharge port, and an air feed including steps of (a) feeding air into the lift pipe, (b) sucking liquid in the suction port, (c) discharging liquid and air at the discharge port, and (d) inducing rotational motion of liquid at the discharge port, whereby the efficiency of said airlift is increased and splashing and heisering are eliminated. An airlift apparatus with means for inducing rotational motion at the discharge port is also provided. The means for inducing rotations can be an inclined flat or curvilinear baffle.

9 Claims, 2 Drawing Sheets

AIRLIFT

FIELD OF INVENTION

The invention belongs to methods and apparatus for lifting aqueous and non-aqueous liquids, suspensions, and emulsions with the help of air or other gases.

BACKGROUND

Airlifts are well known in the prior art. Air is used in airlifts. Other gases are used in gaslifts. In the present invention, these terms are used interchangeably. The main problem of airlifts is significant fluctuations in flows of liquid and air. This results in low lifting efficiency. Moreover, fluctuating flows and poorly organized separation of liquid and gas produce splashes and heisering, which is an operational nuisance.

The main objective of this invention is to eliminate flow fluctuations thus increasing the pumping efficiency of airlifts and to eliminate splashing. Other objectives of this invention will become apparent from the ensuing description.

SUMMARY OF INVENTION

This is a method for lifting liquids with airlift consisting of a lift pipe having a suction port, a discharge port, and an air feed including steps of (a) feeding air into the lift pipe, (b) sucking liquid in the suction port, (c) discharging liquid and air at the discharge port, and (d) inducing rotational motion of the liquid at the discharge port, whereby the efficiency of said airlift is increased. The method can be used for lifting water, wastewater, suspension, emulsion, mixed liquor in biological processes, sludge, biosolids, aqueous industrial products, nonaqueous industrial products, agricultural liquids, animal husbandry liquids and slurries, and combinations thereof. In case of thick sludges and similar materials, a dilute liquid or water can be provided to the suction port.

The airlift comprises a lift pipe having a suction port, a discharge port, an air feed, and means for inducing rotational motion of liquid at the discharge port. The rotational motion can be provided by at least one inclined baffle, at least one curved two-dimensional baffle, at least one tri-dimensional baffle, and combinations thereof. Such rotational motion plays a role of a fly wheel in mechanical systems, thus increasing the airlifting efficiency. Additionally, air is separated from the liquid more gradually without forming air pockets. Accordingly, splashing and heisering due to bursting air pockets are eliminated.

A modification of the present airlift can be used for mixing in large tanks, for example, chemical or biological reactors, or biological ponds. In such applications, induced rotational motion can extend from above the discharge port at the top of airlift to a point between the discharge point and the suction port at the bottom.

The present airlift can be provided with a discharge container at the discharge port, the container can accommodate at least one means for inducing rotational motion. The means for inducing rotational motion can be at least one inclined baffle, at least one curved two-dimensional baffle, at least one tri-dimensional baffle, and combinations thereof.

The present airlift can be provided with a means for controlling air flow. Particularly, a continuous control means, incremental control means, and combinations thereof can be used. The incremental control means can comprise at least two branches of air feed lines and each brunch can be provided with an on/off flow control means.

The present airlift can be installed on a fixed-support structure, or a floating-support structure the floating-support airlift can be provided with a means for propelling it along a predetermined path. The predetermined path can be a circular path, a linear path, and combination thereof.

PREFERRED EMBODIMENTS

Figure 1:
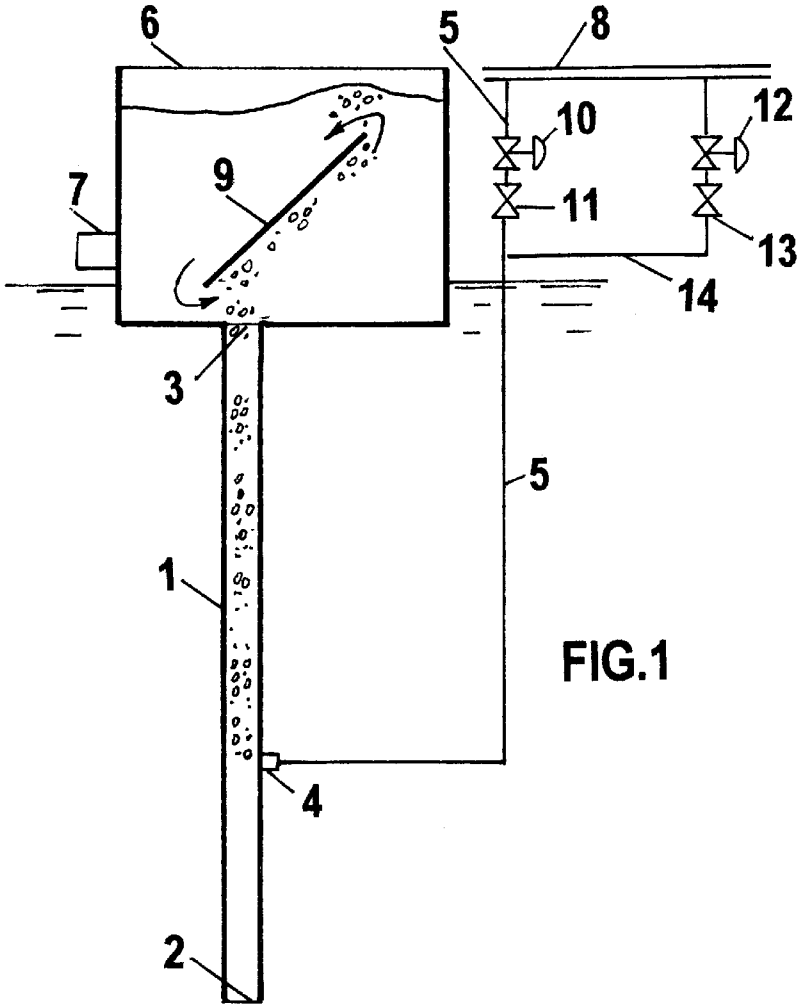
FIG. 1 is a vertical cross-section of the present airlift.

Referring now to FIG. 1, there is shown an airlift comprising a lift pipe 1 having a suction port 2 and disharge port 3, an air main 8 connected to the lift pipe 1 at a port 4. A container 6 is attached to the lift pipe at the port 3. This container has a liquid discharge means 7 and a baffle 9 for inducing flow rotations above the port 3. Optionally, control valve 11 and on/off valve 10 are provided on an air branch 5. Additionally, at least one more optional branch 14 with control valve 13 and on/off valve 12 can also be provided.

Referring now to FIG. 1, the airlift is operated as follows. The air is fed via main 8 and branches 5 and 14 into the lift pipe 1 submerged in liquid. An air-liquid mixture is formed. This mixture has lower density than the non-aerated liquid outside the pipe 1. Accordingly, it floats up in the lift pipe, exits from the port 3 and reaches the flat inclined baffle 9. On the lower (right side in FIG. 1) side of the baffle, the air-liquid mixture continues to flow upward. At the top of the baffle, the bulk of the dispersed air bubbles are separated from the liquid. Also at the upper tip of the baffle, the velocity of the air-liquid mixture is abruptly reduced and the kinetic energy of the rapidly flowing liquid is converted into potential energy, which, in case of a liquid, is a static pressure. Accordingly, the static pressure at the right side of the upper tip of the baffle 9 is greater than that at the left side. This causes the liquid to flow over the tip and down along the baffle. At the lower tip of the baffle 9 on the right, the rapidly flowing air-liquid mixture produces a zone with a reduced static pressure. This causes the stream downflowing along the baffle on its left side to go under the lower tip of the baffle and join the air-liquid stream. Therefore, a rotating component of flow is created. Similarly to a flyweel in rotating mechanical systems, this rotating body has inertia and can reduce the flow rate fluctuations in the lift pipe 1. This also improves the air separation from the air-liquid mixture thus significantly reducing splashes and eliminating heisering. The lifted liquid is discharged via discharge means 7. The simplest discharge means can be an opening in the wall of the container 6, or a pipe of a desired length. If needed, a metering weir, for example a V-notch, can be provided. For simple flow control, branches 5 and 14 can be used. The air flow in each branch can be set with the control valves 10 and 12, the on/off valves can be turned on one by one or simultaneously thus providing three flow rates in the airlift. An increasingly greater number of combinations is possible with more than two branches. It is understood that an assembly of multiple airlifts of the same or different sizes with various means for hydraulic communications (such as channels) or separation (gates) can be used.

Figure 2:
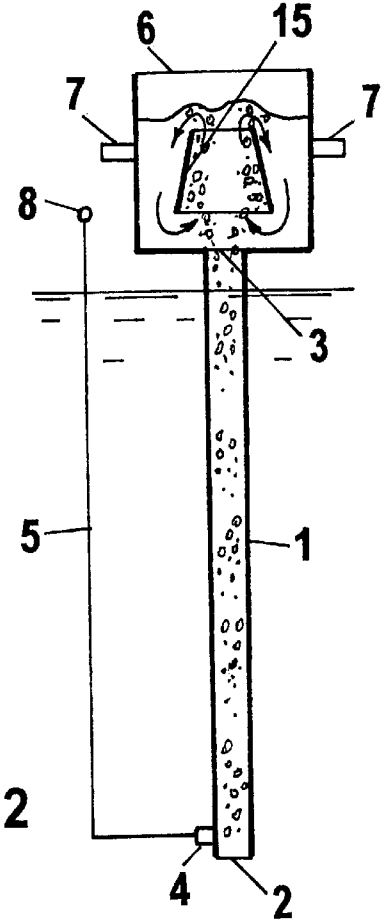
FIG. 2 is a vertical cross-section of an alternative configuration of the present airlift .

Referring now to FIG. 2, there is shown an airlift similar to that shown in FIG. 1, but having a cone baffle 15 instead of a flat baffle. Optional elements of FIG. 1 can also be included. Cone-shaped baffle 15 produces identical effect. The shape of the rotational flow in this case is a toroid-like. Also, two discharge means 7 are optionally provided in FIG. 2.

Figure 3:
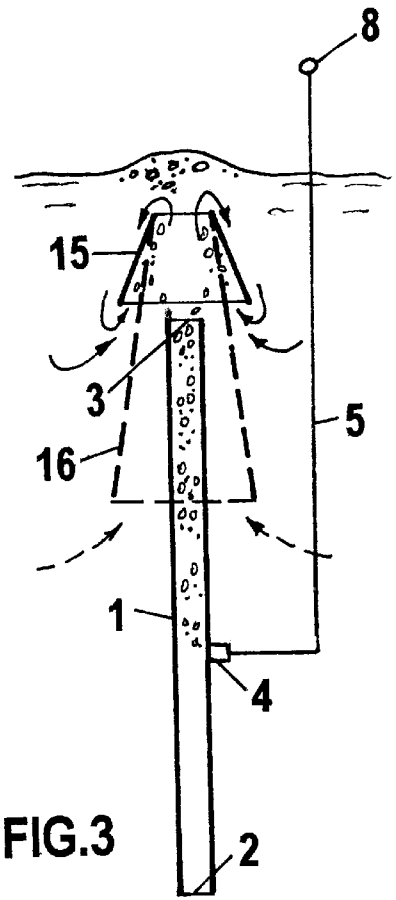
FIG. 3 is a vertical cross-section of another alternative configuration of the present airlift.
Figure 4:
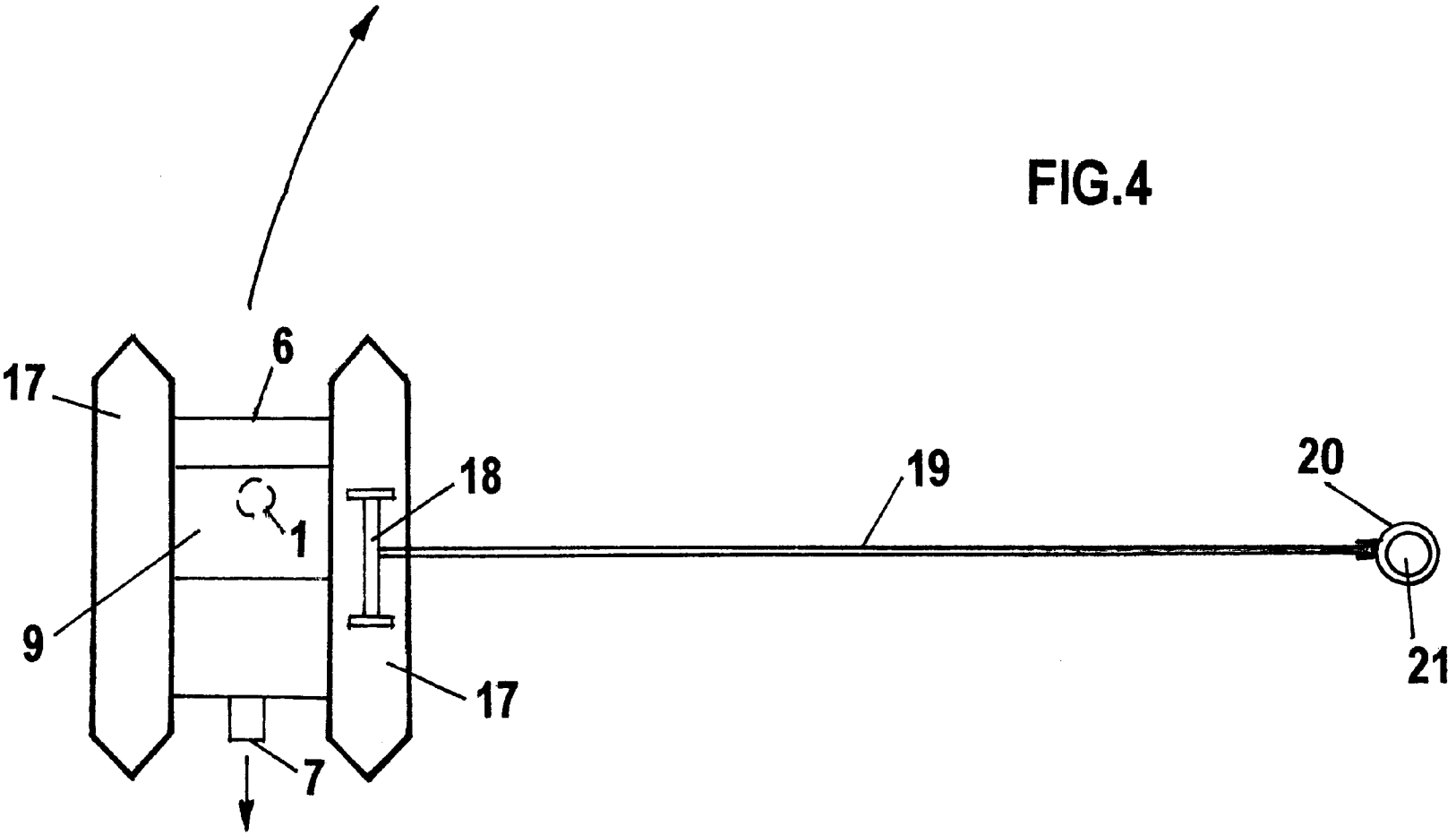
FIG. 4 is a plan view of a float-supported airlift.

Referring now to FIG. 3, there is shown another airlift consisting of a lift pipe 1 having a suction port 2 and discharge port 3. The airlift is provided with the air feed main 8, line 5 and port 4 as previously described. The airlift is also provided with a conical baffle 15 for inducing the rotational flow. Both, the lift pipe 1 and the baffle 15 are submerged in water. Such an airlift is intended primarily for liquid mixing. A toroidal rotational flow is induced as previously described. This rotational flow increases the airlift efficiency and reduces splashing, while also involving a large volume of liquid in the mixing process. An extended cone 16 is shown in FIG. 4 by a broken line to illustrate that the size of the rotating flow can be controlled as may be desired. In general, the top of the cone should be above the discharge port 3 and the cone bottom can extend up to the suction port 2.

Referring now to FIG. 4, there is shown a floating airlift comprising a lift pipe 1, a container 6 with an inclined baffle 9 and the discharge means 7. Floats 17 are attached to the box 6. A system of mechanical link 19 and flexible joints 18 and 20 connects the floating structure to a pile 21. Optionally, air blower is also installed on the floats (not shown). Other provisions for air supply can also be used. The floating airlift itself is operated as previously described. The liquid flow discharged from the means 7 induces the propulsion force, and the entire floating assembly rotates around the pile 21 in a circular path. This airlift can be used for mixing, aeration, or both, specifically, for large bodies of liquid. Alternatively, the floating airlift can be propelled by mechanical means, for example, including a cable with pulleys and motors. Such devices can be moved linearly or in other patterns.

It will therefore be understood by those skilled in the art that particular embodiments of the invention here presented are by way of illustration only, and are meant to be in no way restrictive; therefore numerous changes and modifications may be made, and the full use of equivalents resorted to, without departing from the spirit and the scope of the invention as outlined in the appended claims.

What is claimed is:

1. A method for lifting liquids with airlift including a lift pipe with a lower end and an upper end and having a suction port at said lower end, a discharge port at said upper end, an air feed, including steps of (a) feeding air through said air feed into said lift pipe, (b) sucking said liquid into said suction port, (c) discharging said liquid and said air at said discharge port, and (d) inducing rotational motion of said liquid for creating a hydraulic fly wheel at said discharge port, whereby the efficiency of said airlift is increased.

2. The method of claim 1 and further providing a step of providing a diluting liquid or water to said suction port.

3. An airlift comprising a lift pipe having a lower suction port, an upper discharge port, an air feed line with the air discharge port into said lift pipe and forming an air liquid mixture, a liquid container, a liquid level line, liquid discharge means and means for controllably inducing rotational motion of said liquid; said means for inducing rotational motion comprising a surface transverse to a longitudinal axis of said lift pipe with a lower first end and an upper second end, the lower first end being above said discharge port and the upper second end being at a point below the liquid level line and the lift pipe being located below the lower first end such that the inclined surface adjacent said lower first end flows to the upper second end, the liquid and air separating at the upper second end, the separated liquid flowing from the upper second end to the lower first end of the inclined surface; said lift pipe being directly connected to the bottom of the liquid container so as to move the mixture of air and liquid into the means for inducing rotational motion before being discharged outside the container through said discharge means.

4. The airlift of claim 3, wherein said means for inducing rotational motion is selected from the group consisting of at least one inclined baffle, at least one tri-dimensional baffle, and combinations thereof.

5. The airlift of claim 3, wherein means for controlling air flow is provided, said means is selected from a group consisting of a continuous control means, incremental control means, and combinations thereof.

6. The airlift of claim 5, wherein said incremental control means comprise at least two branches of said air feed and wherein each said brunch is provided with an on/off flow control means.

7. The airlift of claim 3, and further providing a floating-support structure.

8. The airlift of claim 7 and further providing means for propelling said floating-support airlift along a predetermined path.

9. The airlift of claim 8, wherein said predetermined path is selected from the group consisting of a circular path, a linear path, and combination thereof.

* * * * *